US012416453B1

(12) United States Patent
Sorensen et al.

(10) Patent No.: US 12,416,453 B1
(45) Date of Patent: Sep. 16, 2025

(54) HEAT EXCHANGE HEADER WITH REFRIGERANT DISTRIBUTION BY CAPILLARY WICKING POROUS INSERT

(71) Applicant: INTERGALACTIC SPACEWORX, LLC, St. George, UT (US)

(72) Inventors: Cole Sorensen, Hurricane, UT (US); Andrew Kerlin, St. George, UT (US)

(73) Assignee: Intergalactic Spaceworx, LLC, St. George, UT (US)

( * ) Notice: Subject to any disclaimer, the term of this patent is extended or adjusted under 35 U.S.C. 154(b) by 218 days.

(21) Appl. No.: 17/814,257

(22) Filed: Jul. 22, 2022

Related U.S. Application Data

(60) Provisional application No. 63/242,878, filed on Sep. 10, 2021, provisional application No. 63/224,542, filed on Jul. 22, 2021.

(51) Int. Cl.
*F28F 1/02* (2006.01)
*F28D 15/04* (2006.01)
*F28D 21/00* (2006.01)

(52) U.S. Cl.
CPC ..... *F28F 1/022* (2013.01); *F28D 15/04* (2013.01); *F28D 21/00* (2013.01); *F28D 2021/0071* (2013.01); *F28F 2260/02* (2013.01)

(58) Field of Classification Search
CPC ..... F28F 1/022; F28F 2260/02; F28D 15/04; F28D 21/00; F28D 2021/0071
See application file for complete search history.

(56) References Cited

U.S. PATENT DOCUMENTS 2,350,348 A * 6/1944 Gaugler ..... F28D 15/046 29/890.035
4,676,305 A 6/1987 Doty
RE33,528 E 1/1991 Doty
(Continued)

FOREIGN PATENT DOCUMENTS

EP 0191602 8/1986
EP 2278246 1/2020
(Continued)

OTHER PUBLICATIONS

Beyers, et al., Improved Cover Type Header Box Design Procedure, R&D Journal of South African Institute of Mechanical Engineering, 2015, pp. 76-85 (http://www.saimeche.org.za).
(Continued)

*Primary Examiner* — Tho V Duong
(74) *Attorney, Agent, or Firm* — McGarry Bair PC

(57) ABSTRACT

A heat exchanger including a tube stack having a plurality of microtubes configured to transfer heat from a refrigerant to an external fluid. The heat exchanger includes an inlet housing disposed adjacent to a fluid-inlet side of the tube stack. The inlet housing includes a reservoir where refrigerant is stored and where, due to gravity, liquid of the refrigerant pools in a bottom of the reservoir. The heat exchanger includes a wicking insert disposed at a tube stack opening of inlet housing adjacent to and covering the fluid-inlet side of the tube stack. The wicking insert has a porous structure configured to provide a capillary force within the porous structure, and is disposed within the pooled liquid to draw the liquid from the bottom of the reservoir through the porous structure of the wicking insert by the capillary force.

18 Claims, 12 Drawing Sheets

(56) References Cited

U.S. PATENT DOCUMENTS

| | | | | |
|---|---|---|---|---|
| 5,275,232 | A * | 1/1994 | Adkins | F28D 15/04 122/366 |
| 5,896,923 | A * | 4/1999 | Baba | F28F 9/0224 165/173 |
| 6,013,834 | A * | 1/2000 | Colling | B01J 8/006 560/231 |
| 6,415,860 | B1 | 7/2002 | Kelly et al. | |
| 6,892,802 | B2 | 5/2005 | Kelly et al. | |
| 6,983,790 | B2 | 1/2006 | Ippoushi et al. | |
| 6,986,382 | B2 | 1/2006 | Upadhya et al. | |
| 7,131,553 | B2 | 11/2006 | Sanders | |
| 7,434,411 | B2 | 10/2008 | Drost et al. | |
| 7,562,697 | B2 | 7/2009 | Gorbounov et al. | |
| 7,628,883 | B2 | 12/2009 | Daly et al. | |
| 7,757,753 | B2 | 7/2010 | Yanik et al. | |
| 7,775,031 | B2 | 8/2010 | Wood | |
| 8,171,987 | B2 | 5/2012 | Jiang et al. | |
| 8,177,932 | B2 | 5/2012 | Becnel et al. | |
| 8,230,594 | B1 | 7/2012 | Bossard et al. | |
| 8,262,978 | B1 | 9/2012 | Wapner et al. | |
| 9,039,814 | B2 | 5/2015 | Bossard | |
| 9,500,414 | B2 | 11/2016 | Tonkovich et al. | |
| 9,562,464 | B2 | 2/2017 | Keene et al. | |
| 10,006,369 | B2 | 6/2018 | Kupiszewski | |
| 10,048,024 | B1 * | 8/2018 | Sole | F28D 1/05341 |
| 10,914,527 | B2 | 2/2021 | Jekerle | |
| 11,135,688 | B2 | 10/2021 | Englmeier | |
| 11,859,921 | B1 | 1/2024 | Kelly et al. | |
| 2002/0162651 | A1 | 11/2002 | Nakagome et al. | |
| 2003/0029040 | A1 | 2/2003 | Cesaroni et al. | |
| 2004/0206109 | A1 | 10/2004 | Nishiwaki et al. | |
| 2006/0120213 | A1 | 6/2006 | Tonkovich et al. | |
| 2008/0099191 | A1 * | 5/2008 | Taras | F28F 9/028 165/174 |
| 2010/0230081 | A1 | 9/2010 | Becnel et al. | |
| 2010/0282439 | A1 | 11/2010 | Summerer | |
| 2012/0175095 | A1 | 7/2012 | Makhlouf et al. | |
| 2012/0211158 | A1 | 8/2012 | Becnel et al. | |
| 2013/0292104 | A1 | 11/2013 | Park et al. | |
| 2015/0101334 | A1 | 4/2015 | Bond et al. | |
| 2016/0301084 | A1 | 10/2016 | Gendel et al. | |
| 2017/0003039 | A1 | 1/2017 | Lazzari | |
| 2018/0164045 | A1 | 6/2018 | Alahyari et al. | |
| 2018/0252480 | A1 | 9/2018 | Kolb | |
| 2018/0292137 | A1 | 10/2018 | Bauckhage | |
| 2019/0011187 | A1 | 1/2019 | Bucknell et al. | |
| 2019/0017757 | A1 | 1/2019 | Seeholzer et al. | |
| 2020/0064085 | A1 * | 2/2020 | Girardi | F28F 9/0265 |
| 2020/0096259 | A1 | 3/2020 | Pearson et al. | |

FOREIGN PATENT DOCUMENTS

| | | |
|---|---|---|
| KR | 1017272760000 | 4/2017 |
| WO | WO2012006073 | 1/2012 |

OTHER PUBLICATIONS

Mezzo Technologies, Why Mircrotubes? Mezzo has the unique capability to design and manufacture a microtube heat exchanger for a wide range of applications, pp. 1-8 (https://mezzotech.com/why-micro-tubes/-accessed Nov. 6, 2020).

Saffarian et al., Numerical study of shell and tube heat exchanger with different cross-section tubes and combined tubes, Feb. 2019, pp. 1-14 (https://www.researchgate.net/publication/331046793).

Panda, et al., Design study of microchannel heat exchanger headers using experimentally validated multiphase flow CFD simulation, Sep. 2020, vol. 178, pp. 1-3 (https://www.sciencedirect.com/science/article/abs/pii/S1359431120330672).

Morris, M., Mechanical Design of Heat Exchanger, 2020, p. 1 (thermopedia.com/content/946).

Mezzo Technologies, Why Microtubes?: Mezzo Technologies, pp. 1-3 (https://www.mezzotech.com/why-microtubes.html—accessed Jun. 16, 2021).

Mott Corporation, Porous Metal Solutions, Transforming Ordinary Into Extraordinary, pp. 1-8.

ARPA-E Changing What's Possible (project sheet), Aug. 9, 2018, International Mezzo Technologies (arpa-e-comms@hq.doe.gov.

"Increase your performance and sustainability," Reaction Engines Applied Technologies, pp. 1-7 (https://reactiontechnologies.co.uk/technologies/).

"Mezzo's PCM Technology Allows NASA to Reduce the Size and Weight of Their Thermal Systems, " pp. 1-6 (https://www.mezzotech.com).

Mezzo Microchannel Radiator Wins Borgwarner Louis Schwitzer Award, May 21, 2010, https://www.indianapolismotorspeedway.com/news-multimedia/news/2010/05/21/mezzo-microchannel-radiator-wins-borgwarner-louis-schwitzer-award.

Baton Rouge's Mezzo Technologies Looking Beyond Racecar Tracks to Space, Updated Jul. 29, 2019, The Advocate, https://www.theadvocate.com/baton_rouge/news/business/baton-rouge-s-mezzo-technologies-looking-beyond-racecar-tracks-to-space/article_7b8701c7-11e4-5db5-b2be-1238ba3a91e4.html.

ARPA-E Projects to Develop New Technologies for High Performance Heat Exchangers, Components, Mar. 22, 2019, https://www.energy.gov/articles/doe-announces-36-million-high-temperature-materials-projects.

Breedlove et al., Turbo-Brayton Converter for Radioisotope Power Systems, Nuclear and Emerging Technologies for Space, American Nuclear Society Topical Meeting, Richland, WA, Feb. 25-28, 2019.

Izenson et al., Integrated Oxygen Flow Meter/Heat Exchanger for Portable Life Support Systems, 48th International Conference on Environmental Systems, Albuquerque, NM, Jul. 8-12, 2018.

* cited by examiner

HEAT EXCHANGE HEADER WITH REFRIGERANT DISTRIBUTION BY CAPILLARY WICKING POROUS INSERT

CROSS-REFERENCE TO RELATED APPLICATIONS

This application claims the benefit of the filing date of U.S. Provisional Application Ser. No. 63/224,542, filed on Jul. 22, 2021, entitled "Heat Exchanger Header with Refrigerant Distribution Capillary Wicking Porous Metal", as well as the entire disclosure of which is hereby incorporated by reference into the present disclosure. Further, this application claims the benefit of the filing date of U.S. Provisional Application Ser. No. 63/242,878, filed on Sep. 10, 2021, entitled "Heat Exchanger Header with Refrigerant Distribution by Capillary Wicking Porous Metal", as well as the entire disclosure of which is hereby incorporated by reference into the present disclosure.

BACKGROUND

1. Field

The present disclosure relates to microtube heat exchangers for use in aerospace and related applications. More particularly, the disclosure is most directly related to microtube heat exchangers with refrigerant flow distribution technology.

2. Description of Related Art

Many microtube heat exchangers involve the circulation of a heat exchange working fluid through a variety of passageways. Traditionally, in nearly all configurations with a heat exchanger in an aerospace system configuration, the passageways for the heat exchange fluid, i.e., the hoses or tubing, leading to a point of entry into the heat exchanger header, have a total cross-sectional area that is much smaller than the total cross-sectional area of the passageways in the heat exchanger summed together. For example, the point of entry into an aerospace refrigerant microtube heat exchanger header or manifold might have a cross-sectional area that is $1/10^{th}$ the area of all active heat exchange flow paths summed together.

Initially refrigerant vapor occupies a disproportionate fraction of available volume immediately downstream of an expansion valve of the system when the refrigerant separates into two phases (liquid and vapor). This vapor can hinder the working fluid liquid from freely entering all heat exchanger channels with uniform distribution.

Traditional refrigerant distribution technology often employs a mixing device or orifice to combine the separated two-phase vapor-liquids together into a homogenous mixture, and supplies this mixture among several channels to the heat exchanger. Some technologies introduce the separated two-phase liquid into an open heat exchanger header, and this configuration further exacerbates the issue with more expansion and separation. This reduces the overall efficiency of the heat exchanger as numerous tubes or channels contain only vapor such that little or no heat exchange occurs. Furthermore, current conventional technology typically can only supply approximately 40-50 channels or tubes to a single heat exchanger. Such conventional technology cannot effectively be used when a heat exchanger contains thousands of microtubes.

Accordingly, there is need for technology within the heat exchanger headers to solve the issue where refrigerant, which is sensitive to sudden expansion and sudden contraction flow distributions, enters the header and spreads poorly, creating a regional loss in efficiency. As the refrigerant enters the more open space of the heat exchanger header, a separation of the two-phase refrigerant within the header often occurs. This separation reduces the overall efficiency of the heat exchanger.

Therefore, despite the well-known characteristics of heat exchanger headers, there are still substantial and long-felt unresolved needs for improving fluid flow through a microtube heat exchanger to reduce or eliminate the two-phase separation of the working fluid to improve the overall efficiency of the heat exchanger.

The current disclosure addresses microtube heat exchanger challenges discussed herein with developments in the working fluid's distribution through the microtubes. Preferred embodiments incorporate a porous insert that is geometrically compatible with the headers of a microtube heat exchanger. By way of capillary force, working fluid is pulled through the pores and ultimately saturates a section of the porous insert, thereby enabling the working fluid to enter the microtubes uniformly at even rates.

SUMMARY

The innovations of the disclosed embodiments improve the headers in heat exchanger assemblies by incorporating a porous insert to direct and distribute refrigerant among an array of microtubes in a microtube heat exchanger. The disclosed technology incorporated into the microtube heat exchanger header improves the distribution of liquid refrigerant, i.e., helps to reduce or eliminate the separation of the phases such that the working fluid remains more of a mixture, thus driving higher overall efficiency of the microtube heat exchanger.

Systems that typically incorporate heat exchangers, like many systems in the aerospace industry, also incorporate computer technology and advanced electronics. As a result, there has long been a demand for developments in heat exchanger technology to achieve better efficiency ratings while minimizing weight. In light of the present disclosure, higher efficiency is achievable due to minimizing phase change and separation in the heat exchanger headers, while still achieving the basic heat exchange functionality. Instead of changing or separating in the header, the phase change of the refrigerant largely occurs within the microtubes themselves, which increases the overall efficiency of the microtube heat exchanger. This is due in part to promoting liquid flow (rather than vapor flow) through more of the microtubes, which in turn is achieved by encouraging a more uniform distribution of the liquid refrigerant from the header to the microtubes. Additionally, the methods and systems described herein effectively eliminate a need for a mixing device, thus heat exchanger efficiency demands are achieved without a significant increase in weight and without a significant pressure drop of the working fluid.

In the preferred embodiment, the heat exchanger header incorporates a porous insert at the inlet of the heat exchanger. The capillary force of the porous insert improves an even distribution of the working fluid as it travels from the header into the tube-stack containing the microtubes, and in particular embodiments, thousands of microtubes. Moreover, in some embodiments where the porous insert is porous metal or another porous construct having thermally conductive properties, thermal conductivity helps further increase the heat exchange function of the heat exchanger. For applications where the working fluid pools inside the headers, the porous insert uses capillary force to distribute the working fluid upward and evenly across the microtubes. In other applications where the working fluid undergoes phase separation, the porous insert may be used as a diffuser to spread the two-phase working fluid evenly across the microtubes.

Specifically, various embodiments of this disclosure include a heat exchanger for heating or cooling refrigerant fluid of a heat exchange system. The heat exchanger includes a tube stack assembly including a plurality of microtubes aligned substantially parallel to each other to form a tube stack, wherein refrigerant fluid is configured to pass through the plurality of microtubes so that heat can be transferred between the refrigerant fluid and an external fluid flowing past the exterior of the plurality of microtubes. The heat exchanger also includes an inlet housing disposed adjacent to a refrigerant fluid inlet end of the tube stack assembly. The inlet housing includes a reservoir and an entry port configured to be coupled with a refrigerant fluid line of a heat exchange system. Refrigerant fluid is configured to enter the inlet housing via the inlet and be stored in the reservoir, where, due to gravity, liquid of the refrigerant fluid is configured to pool in a bottom of the reservoir. The heat exchanger further includes a wicking insert disposed at a tube stack opening of inlet housing adjacent to and covering the refrigerant fluid inlet end of the tube stack assembly, where the wicking insert comprises a metal material and has a porous structure configured to provide a capillary force within the porous structure. A bottom of the wicking insert is disposed within the pooled liquid of the refrigerant fluid and the wicking insert is configured to draw the liquid of the refrigerant fluid from the bottom of the reservoir through the porous structure of the wicking insert due to the capillary force.

Another embodiment incorporates a porous material in the microtubes themselves. The porous material may be contained internally as a core or section within the microtubes, or as a sleeve that coats the inner tube wall surface leaving a channel or opening through the middle of the microtube.

Still another embodiment uses an assembly of tubes, referred herein as a capillary bundle ("capillary bundle"). The capillary bundle can be used to regulate the flow of working fluid passing through headers with internal passageways. Much like the other embodiments of the current disclosure, the diameter of each tube enables capillary force to pull working fluid through a header equipped with internal passageways. The material of the capillary bundle may be compatible with various working fluids outside the context of the present disclosure. The capillary bundles may be inserted into alternative embodiments of heat exchanger headers where internal conduits are used to redirect the working fluid in multi-pass heat exchangers, thereby maintaining a mixed two-phase working fluid without an appreciable pressure drop.

BRIEF DESCRIPTIONS OF THE DRAWINGS

DETAILED DESCRIPTION OF PREFERRED EMBODIMENTS

The following descriptions relate to presently preferred embodiments and are not to be construed as describing limits to the invention, whereas the broader scope of the invention should instead be considered with reference to the claims, which may be now appended or may later be added or amended in this or related applications. Unless indicated otherwise, it is to be understood that terms used in these descriptions generally have the same meanings as those that would be understood by persons of ordinary skill in the art. It should also be understood that terms used are generally intended to have the ordinary meanings that would be understood within the context of the related art, and they generally should not be restricted to formal or ideal definitions, conceptually encompassing equivalents, unless and only to the extent that a particular context clearly requires otherwise.

For purposes of these descriptions, a few wording simplifications should also be understood as universal, except to the extent otherwise clarified in a particular context either in the specification or in particular claims. The use of the term "or" should be understood as referring to alternatives, although it is generally used to mean "and/or" unless explicitly indicated to refer to alternatives only, or unless the alternatives are inherently mutually exclusive. When referencing values, the term "about" may be used to indicate an approximate value, generally one that could be read as being that value plus or minus half of the value. "A" or "an" and the like may mean one or more, unless clearly indicated otherwise. Such "one or more" meanings are most especially intended when references are made in conjunction with open-ended words such as "having," "comprising" or "including." Likewise, "another" object may mean at least a second object or more.

The following descriptions relate principally to preferred embodiments while a few alternative embodiments may also be referenced on occasion, although it should be understood that many other alternative embodiments would also fall within the scope of the invention. It should be appreciated by those of ordinary skill in the art that the techniques disclosed in these examples are thought to represent techniques that function well in the practice of various embodiments, and thus can be considered to constitute preferred modes for their practice. However, in light of the present disclosure, those of ordinary skill in the art should also appreciate that many changes can be made relative to the disclosed embodiments while still obtaining a comparable function or result without departing from the spirit and scope of the invention.

Figure 1A:
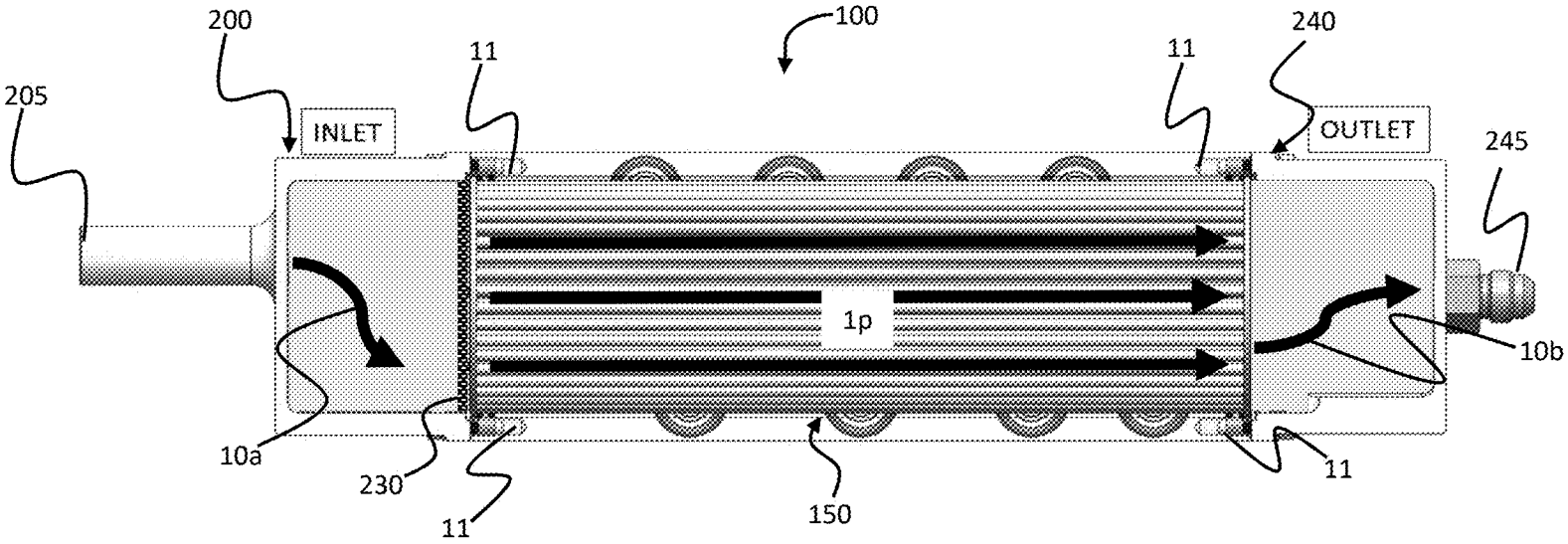
FIG. 1A illustrates a cutaway side view of a microtube heat exchanger, according to an embodiment of this disclosure.

Looking at FIG. 1A, shown is an illustration that is representative of a heat exchanger 100 described in the present disclosure. The intended flow pattern of the working fluid or liquid can be seen by observing arrows 10*a*, 1*p*, and 10*b*. In preferred embodiments of the present disclosure, the working fluid is typically R134a refrigerant ("refrigerant"), however, those of skill in the art will appreciate that other types of refrigerants, coolants, water, and other working fluids could also be used. Heat exchanger 100 is shown with flow arrows 1*p* depicting the flow direction characteristic of a single-pass heat exchanger system as the system's working fluid flows through a heat exchanger tube-stack assembly 150. Preferred embodiments discussed herein are incorporated with respect to single-pass microtube heat exchanger systems, however it should be understood by those of ordinary skill in the art that the presently disclosed embodiments may be incorporated in other heat exchangers with differing tube stack assembly arrangements, orientations, and multi-pass configurations.

Tube stack assembly 150 contains a plurality of microtubes 151, and, in some embodiments, even contains dozens, hundreds, or even thousands of microtubes 151. An external fluid flows past an outer surface of the plurality of microtubes 151 ("shell-side") to cool or heat the refrigerant fluid flowing internally through the plurality of microtubes 151 ("tube-side"). In liquid-cooled heat exchangers, the external fluid is a liquid, such as for example water or a coolant in some embodiments. In gas-cooled heat exchangers, the external fluid is a gas, such as for example air in some embodiments. Microtubes 151 each have an inner diameter (ID) that are measurable on a microinch or micrometer scale. For example, in some preferred embodiments, each microtube 151 has an ID of substantially 0.003-0.030 inch, and outer diameter (OD) of 0.01-0.1 inch, and a wall thickness of 0.0018-0.01 inch. Those with skill in the art will understand that microtubes 151 can have IDs, ODs, and wall thicknesses less or greater than what has been described without departing from the scope of this disclosure. As previously discussed, in some embodiments of the disclosure, there are several thousand of microtubes 151 in tube stack 150. For example, in one embodiment, the tube stack 150 has 6,700 microtubes 151. In some embodiments, there are 700-1,100 microtubes 151 per square inch of end plate 12. Each tube 151 can be made from any of a number of commonly used methods, such as by being rolled and seam-welded or extruded. In some embodiments, tubes 151 are made from stainless steel alloys, such as 304 stainless steel or 316 stainless steel, for example. However, microtubes 151 can be made from any of a number of materials, such as, for example, super alloys (such as Inconel), titanium, or aluminum.

A hose or another type of conduit of system 50 (discussed in referencing FIG. 1B, below) can be attached to an inlet header 200 at an entry port 205, which provides fluid flow 202 into the inlet header 200, and the fluid then passes from the inlet header 200 and enters the heat exchanger tube-stack assembly 150. After flowing through the tube stack 150, the working fluid exits through the outlet header 240 at an outlet port 245. Both the inlet header 200 and outlet header 240 are substantially fastened to a housing of the tube stack 150 with screws 11 or other similar fastening methods, either removable or permanent. A porous metal insert 230 is disposed at a tube-side opening of inlet header assembly 200. As will be discussed in greater detail below, insert 230 is configured to utilize inherent capillary adhesion to evenly distribute refrigerant across an inlet-side of the tube stack 150. Insert 230 can be secured within header 200 according to any of a number of methods including, such as, for example, by a gasket, crush sealing, a wave spring, an adhesive, welding, clamps, or fasteners.

Figure 1B:
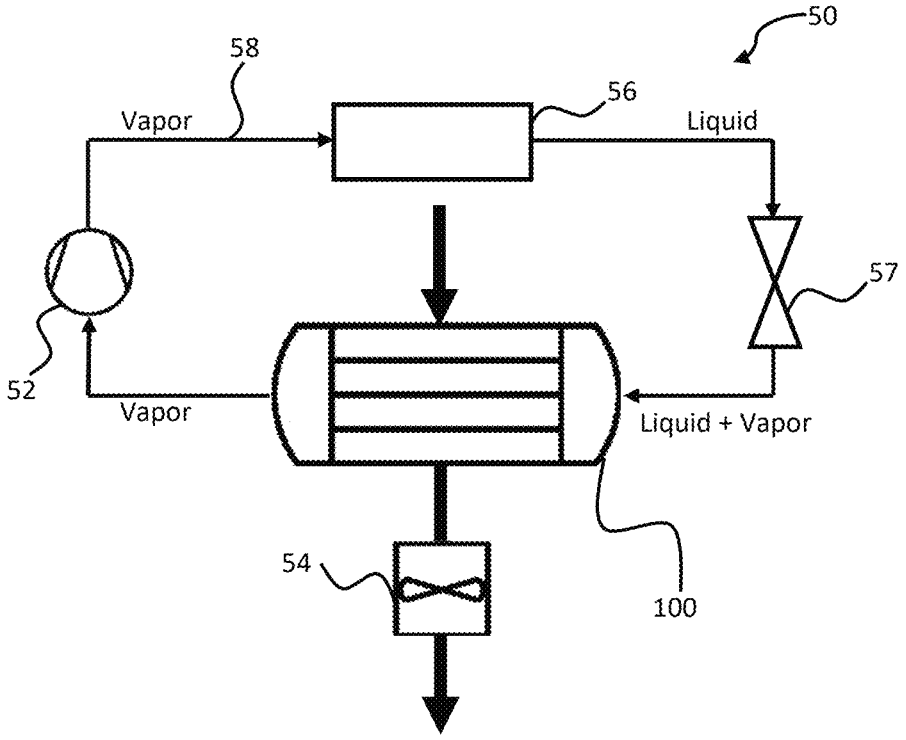
FIG. 1B illustrates a heat exchange system incorporating the heat exchanger of FIG. 1A.

FIG. 1B illustrates a schematic of a heat exchange system 50 of this disclosure, incorporating heat exchanger 100. Specifically, system 50 is a vapor-compression cycle refrigerant system. System 50 includes heat exchanger 100 configured to operate as an evaporator, a fan 54 configured to move an external fluid past tube stack 150, a refrigerant compressor 52 coupled with outlet 245, a condenser 56, an expansion valve 57, and a refrigerant loop line 58 configured to fluidly couple compressor 52, heat exchanger 100, condenser 56, and expansion valve 57 as has been described. In the illustrated embodiment, the external fluid that flows past the exterior of tube stack 150 is air moved by fan 54, however, those with skill in the art will recognize that, in other embodiments, the external fluid can be another type of gaseous fluid or a liquid fluid. Although compressor 52 is described herein as a compressor, those with skill in the art will recognize that, according to various other embodiments, compressor 52 is a pump.

As mentioned above, system 50 is an evaporator system in which heat exchanger 100 is configured to act as an evaporator, and warm air is cooled by heat exchanger 100 as fan 54 moves the air past the tube stack 150. Heated refrigerant vapor is expelled from outlet 245 due to a motive force created by compressor 52 and provided to condenser 56 where the compressed refrigerant vapor is condensed into a liquid. The refrigerant liquid then passes through expansion valve 57 where it becomes a liquid-vapor mixture and is cycled back to inlet 205 of heat exchanger 100.

Figure 2:
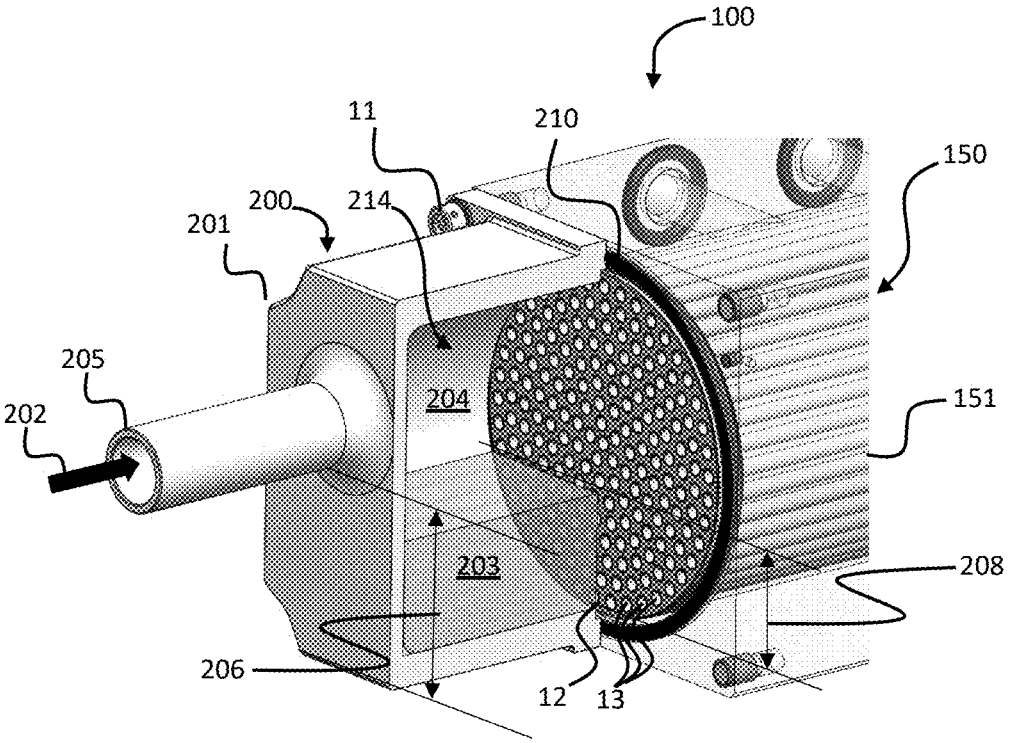
FIG. 2 illustrates a partial cutaway perspective view of a working fluid inlet end of the heat exchanger of FIG. 1A.

FIG. 2 illustrates a representative perspective partial cross-sectional view of microtube heat exchanger inlet assembly 200, having header 201 attached to tube stack 150, without incorporating a porous insert 230. The header 201 is fastened to the tube stack 150 via screws 11, or some other similar fastening method. A gasket 210 is disposed between the header's 201 front face 207 (shown in FIG. 3) and a tube-stack face plate 12. Plate 12 has a plurality of holes 13 each aligned with an inlet-side end of one of the microtubes 151 such that refrigerant can pass between header 201 and the interior of the microtubes 151 through the holes 13 of plate 12. In some embodiments, plate 12 is coupled with each of the plurality of microtubes, such as by welding or another adhesion process.

Under normal operating conditions, the working fluid enters the header 201 via opening 205. Arrow 202 is representative of the flow direction of the working fluid when entering the header 201. A reservoir 214 of the header 201 contains both a liquid phase of the working fluid, represented as 203, and a vapor phase, represented as 204. Two-phase separation of the refrigerant occurs upstream of opening 205 due to free expansion from the expansion valve with additional separation in reservoir 214 caused from sudden expansion into a volume larger than the inlet passageways connected to the header opening 205, which allows the refrigerant to expand into the open space of reservoir 214 which also induces a pressure drop.

In some traditional heat exchangers, there is a mixing device and channel routing in the heat exchanger inlet assembly to create and maintain a homogenous mixture of the two phases, thus adding more weight and size to the overall heat exchanger assembly. As previously discussed, traditional methods of refrigerant distribution are limited to 40-50 supply channels and are not suitable for tube stacks containing thousands of tubes. When utilizing just the mixing technology, the homogenous mixture enters the tube stack, and the amount of mixed 2-phase working fluid is limited by the inlet cross-sectional area into the heat exchanger. Without a method to transport the working fluid vertically and across tube stack end plate, the 2-phase mixture quickly separates into liquid and vapor and the distribution of the working fluid across the entrance of the tube stack is limited to the height of the liquid phase working fluid. As a result, working fluid liquid does not enter all microtubes which significantly lowers the heat exchanger's effectiveness. An additional concern is that as working fluid liquid in the microtubes vaporizes, a bubbling backflow effect can occur from the vapor cavities of both the inlet and outlet headers having a balance of pressure, which causes vapor to move upstream through the liquid and intermittently prevent liquid from entering the tube stack. Without any mechanism to prevent the backflow effect, the working fluid does not flow continuously and unidirectionally through the microtubes, thus also lowering heat exchanger efficiency.

Figure 3:
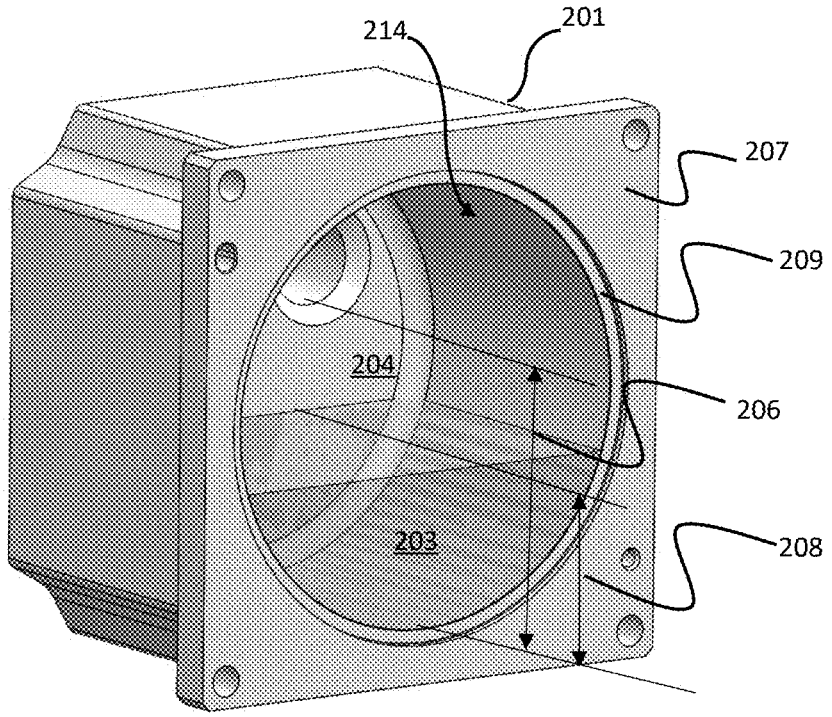
FIG. 3 illustrates a perspective view of a working fluid inlet header of the heat exchanger of FIG. 1A.

FIG. 3 illustrates a representative front perspective view of microtube heat exchanger header 201 detached from tube stack 150. The header 201 depicted is intended to fit on a heat exchanger with a circular shaped tube-stack 150, however those of skill in the art will appreciate that there are alternative embodiments intending to fit on tube-stacks 150 with other geometries, and the present disclosure is not limited to application with circular tube-stack assemblies.

Figure 4A:
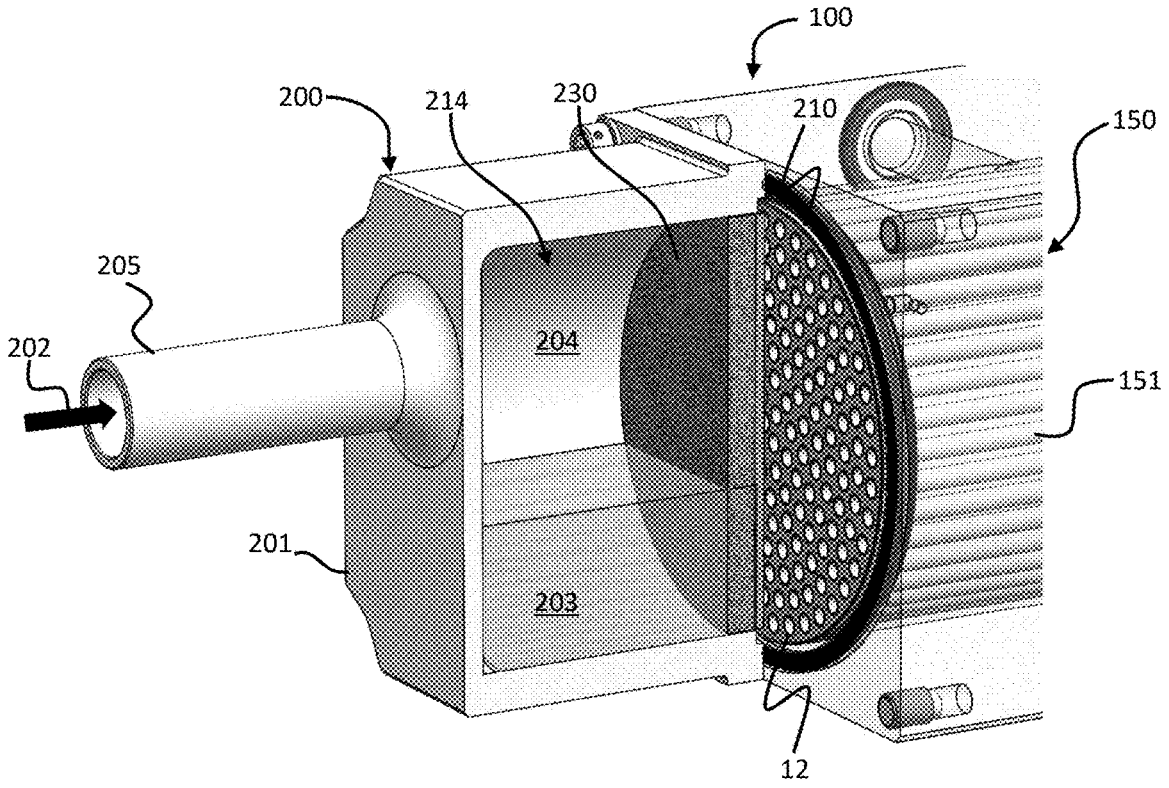
FIG. 4A illustrates a partial cutaway perspective view of a working fluid inlet end including a wicking insert of the heat exchanger of FIG. 1A.

FIG. 4A illustrates a representative perspective partial cross-section view of microtube heat exchanger inlet assembly 200, of which the header 201 is attached to tube stack 150 with fasteners 11. Within the header 201 and preferably immediately adjacent the plate 12, porous insert 230 is disposed. It should be noted that the porous insert 230 is similar to those developed by the Mott Corporation, which are typically constructed out of metal, however, any other material that can be made into a porous medium and is compatible with the working fluid is sufficient for many embodiments. Moreover, preferred embodiments comprise a porous medium with a nominal pore size range of 0.2 micrometers to 100 micrometers, depending on the application and working fluid characteristics. The shape of the pores can be best described as spherical, of which the nominal pore size regards the pore's diameter in micrometers. Those of skill in the art may use microns to describe the media grade of the porous medium. For example, using the term "media grade 1" to describe a porous medium, refers to a porous medium having a nominal pore size of 1 micron. Therefore, a media grade range of 0.2 to 100 may also describe the nominal pore size range of preferred embodiments.

Depending on the application, porous insert 230 may be manufactured using sintering, additive manufacturing, or other similar manufacturing methods. Preferred manufacturing methods include sintering and three-dimensional printing ("3D Printing or 3DP"), each of which result in slight variations of material properties. The sintering process comprises a powder of metal or plastic, which is heated to a temperature below the liquidus point, however, is hot enough to bond each solid particle in the powder. The temperature range needed for sintering largely depends on the melting temperature of each material. Regardless of material, the sintering process effectively manufactures an open-cell, porous rigid body. Those of skill in the art may use the term "solid state diffusion bonding" to describe more detailed characteristics of the sintering process. With solid state diffusion bonding, the atoms across the boundary of each solid particle in the powder are fused with the atoms across the boundary of each adjacent at a level, which may result in higher tensile strengths. Porous inserts 230 manufactured with a sintering process can be appropriate for applications where high pressure differentials, flow rates, and vibration are a concern, much like the microtube heat exchanger 100 systems discussed herein.

Much like the sintering process of manufacture, 3D printing incorporates the general concept of bonding a powdered metal or plastic, and in some technologies, uses a form of sintering. According to some embodiments, 3D printing results in porous bodies being better suited for low-pressure differential applications, rather than the high-pressure differentials seen in traditional sintering methods discussed above. There are several types of 3D printing that could be used to manufacture porous insert 230, however the use of lasers is becoming the preferred technology amongst manufacturers. Variants of the porous insert 230 may include a coating to help prevent backflow. In some embodiments, the coating is applied to a section of the porous insert 230 that is furthest away from the tubes-stack face plate 12, which can prevent the liquid working fluid from leaking out of the porous insert 230 back toward the reservoir 214. Regardless of the specific application method, the coating must be applied in such a way that allows liquid working fluid to enter the porous insert 230 and wick upwards.

Some embodiments of the porous insert 230 have randomly positioned pores that are uniform in size. The size of the pores is dependent on the desired surface tension, density, and contact angle of the working fluid flowing therethrough. To explain in more detail, if the pore's diameter is sufficiently small, a combination of the working fluid's surface tension and adhesive forces between the working fluid and the wall of the pores cause the working fluid to be lifted, which will be described in greater detail below. This is known to those of skill in the art as capillary force, capillary action, capillary motion, capillary adhesion, or wicking. The porous insert 230 is positioned inside the header 201 flush with surface 209 (shown in FIG. 3) and directly up against the tube-stack faceplate 12. The porous insert 230 wicks, transports, and more evenly distributes the liquid phase of the two-phase working fluid across the face of the tube-stack 150 to the individual microtubes 151.

The size, shape, and material of the porous insert 230 is compatible with the working fluid and geometry of the corresponding tube-stack face plate 12. For example, a square shaped tube-stack 150 requires a square shaped porous insert 230. Although the current disclosure depicts porous insert 230 of a circular or disc shape, those of skill in the art will appreciate that many other shapes can be used in applications where the cross-sectional shape of the tube-stack 150 is other than what is described in the current disclosure.

Figure 4B:
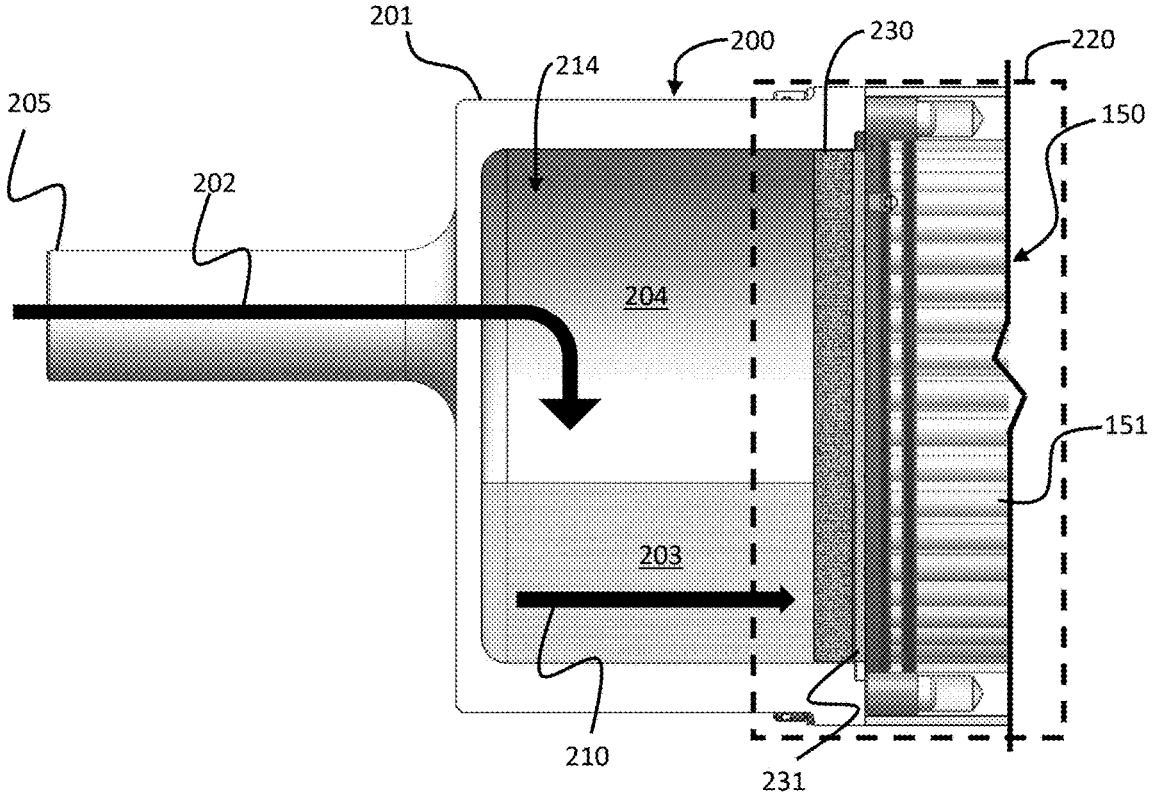
FIG. 4B illustrates a cutaway side view of a working fluid inlet end of heat exchanger of FIG. 1A

Looking to FIG. 4B, arrow 202 illustrates the flow of the working fluid after it enters the header 201, a pool of refrigerant in liquid form 203 (which can be referred to herein as working fluid) forms at the bottom of the reservoir 214 due to gravity. The working fluid 203 is pulled towards the porous insert 230, due to the motive force created by compressor 52, represented by arrow 210, as the working fluid is wicked upwards due to the inherent capillary adhesion properties of the insert 230, shown for representative purposes as arrow 211 in FIG. 4C, and towards the microtubes, which is represented by arrows 212 in FIG. 4C. A section 231, referred hereinafter as the "saturated section", of the porous insert 230 becomes saturated with working fluid. This saturated section 231 is in continuous contact with the entrance to the microtubes 151 and allows the working fluid to enter the microtubes 151 evenly.

To elaborate the above concept further, refrigerant vapor 204 and refrigerant liquid 203 in the header 201 is drawn towards the microtubes via compressor inlet suction. The saturated section 231 of porous insert 230 is located between vapor 204 and the tube-stack face plate 12. Vapor 204 must pass through the saturated section 231 of the porous insert 230. In other words, suction is created by an externally attached compressor 52 at the outlet side, which then pulls vapor 204, liquid 203, and suspended liquid located in the saturated section 231 towards the microtubes. As the vapor 204 travels through porous insert 230, suspended liquid is entrained in a vapor 204 stream and travels through the pores towards the microtubes. It should be noted that the working fluid is pulled into the porous metal by capillary force and later expelled from the porous insert 230 by the velocity of the vapor 204. Those of skill in the art may also refer to capillary force as capillary action, capillary adhesion, or wicking. With the teachings of the present disclosure, more microtubes contain liquid rather than just vapor refrigerant, thus increasing heat exchanger efficiency.

Figure 4C:
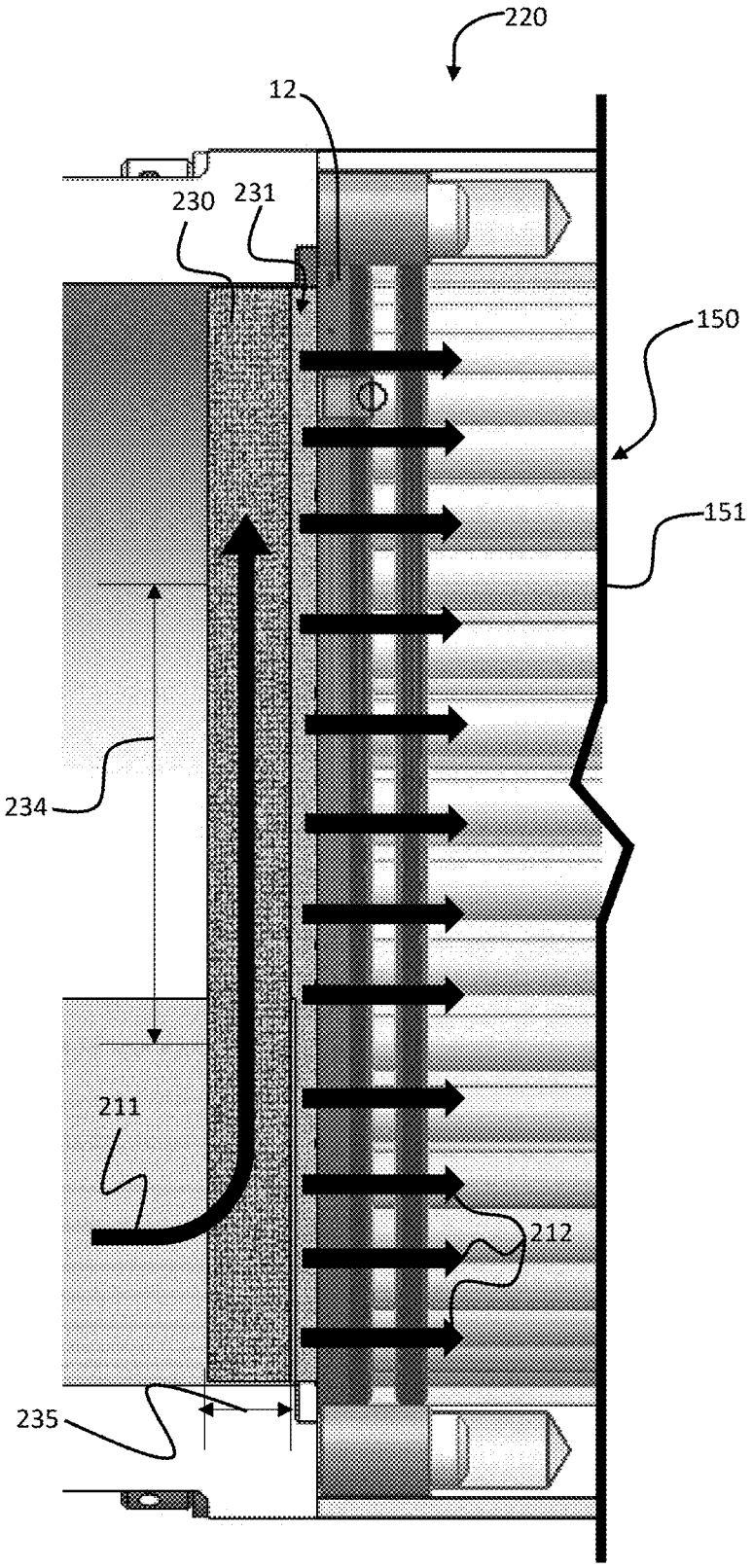
FIG. 4C illustrates a magnified view of a section of FIG. 4B.

FIG. 4C illustrates a representative close-up cutaway view of the interface between the porous insert 230, working fluid, and tube-stack face plate 12, which is shown for illustrative purposes as the dashed box 220 in FIG. 4B. As the compressor 52 motive force builds, vapor upstream of the porous insert 230 will get drawn through the metal pores and towards the tube-stack 150. Those of skill in the art will appreciate the heat exchanger's 100 role in broader yet related systems, where detailed description of such systems are beyond the scope of the current disclosure. Pieces of equipment that are a part of these broader systems, such as a compressor or expansion valve, are mentioned to provide context. Arrow 211 illustrates the direction of the working fluid as it is drawn upward into the porous insert 230 by the inherent capillary adhesion force of insert 230. The size and shape of the pores in conjunction with the working fluid's properties dictate the height 234 at which the working fluid will wick. A thickness 235 of the porous insert 230 contributes to a desired pressure drop across the microtubes 151.

For most heat exchanger systems, pressure drops are ideally minimized to reduce phase separation to obtain higher heat transfer efficiency. The thickness 235 of the porous insert 230 can impact the pressure drop of the overall system in that the greater the thickness, the greater the pressure drop across the porous insert 230. Shown below is a theoretical equation Eq.1 illustrating the relationship between thickness "t" [in] of the porous insert 230, the system's 100 pressure drop "ΔP" [psid], the permeability coefficient "K" [unitless] of the porous metal insert 230, flux "Φ" [gpm/ft^2 for liquid, acfm/ft^2 for gas] of the working fluid's flow through the porous insert 230, and the viscosity "μ" [cP] of the working fluid.

$$t = \frac{\Delta P}{K\Phi\mu} \qquad \text{Eq. 1}$$

With the use of this equation, an optimized thickness 235 of the porous insert 230 can be calculated relative to the conditions of application, however other methods for determining the thickness can be used. Those of skill in the art should know that the permeability coefficient annotation varies depending on whether the working fluid is in a liquid state or a gaseous state, indication of which may be annotated outside of the present disclosure as $K_l$ or $K_g$ respectively. For applications where variable pressure drops are desired, variable thickness of a single insert could provide more precise pressure drops relative to where the working fluid enters the tube stack 150. As will be discussed in greater detail below, an insert having a coned or rounded thickness will have the greatest pressure drop at portions of the insert with the greatest thickness.

After being pulled upward and passing through the porous metal insert 230, illustrated by arrows 211, the working fluid liquid collects in a saturated section 231, thus allowing the working fluid liquid to evenly distribute across the tube-stack face plate 12. Because the working fluid liquid is evenly distributed across the tube-stack face plate 12, and in turn, the working fluid liquid is more evenly distributed to the individual microtubes 151, the heat exchanger efficiency increases. Various embodiments of the current disclosure may incorporate a porous insert 230 that employs a gradient of pore size and density throughout its thickness, with the pore density being greatest at the section of the porous insert 230 closest to the tube-stack face plate 12, which allows a greater collection of liquid in a saturated section 231 and further improves distribution of the working fluid. In some embodiments, pore density of insert 230 and pore size are directly correlated. For example, as those with skill in the art will understand, as pore size gets smaller, pore density of inert 230 increases, and vice versa. So, in embodiments where insert 230 employs a gradient pore density throughout its thickness 235, with the pore density being greatest at the section of the porous insert 230 closest to tube-stack face plate 12 and decreasing along the thickness going away from tube-stack face plate 12, the insert 230 locations with the greatest pore density incorporate a small pore sizes, and the pore size increases as the pore density of insert 230 decreases across thickness 235.

The specific dimensions and porous structure of insert 230 is dependent on the specific design parameters of the heat exchanger 100 and the system 50 in which it is incorporated. Many of insert's 230 properties such as the thickness, insert material, pore density, pore size, pore placement, and pore diversity, for example, are dependent on various deliverables, such as desired wicking force, the desired saturated area 231, the desired pressure drops across the heat exchanger 100, and the desired refrigerant distribution across the tube stack 150.

In some embodiments, insert 230 is made from metal, such as metal alloy, including 316L SS, 310 SS, Titanium, Inconel 600, Hastelloy® C-276, Hastelloy® X, Monel® 400, and Nickel 200, for example. However, in other embodiments, insert is made from other metals. Insert can also be made from various other materials capable of providing the capillary adhesion described and compatible with the working fluid, such as various plastics, foams, fibers, ceramics, glass, or polymers, for example. According to various embodiments, the pore size of insert can range anywhere from 0.2 microns to 100 microns, although those of skill in the art will recognize that, according to various embodiments, insert 230 can have pores smaller than 0.2 microns and larger than 100 microns. In some embodiments, insert 230 has consistent pore sizes throughout the structure of insert 230, while, in other embodiments, insert 230 has variable pore sizes throughout the structure of insert 230. Additionally, as previously discussed, in some embodiments insert 230 has a consistent pore density throughout the structure of insert 230, while, in other embodiments, insert 230 has a variable pore density throughout the structure of insert 230. For example, as previously discussed, in some embodiments, the density is variable across thickness 235, and insert 230 has a greatest pore density on the surface of insert 230 adjacent to and facing plate 12, and the pore density of insert 230 decreases moving across the thickness 235 to the opposing surface of insert 230, where insert 230 has a smallest pore density.

Figure 5A:
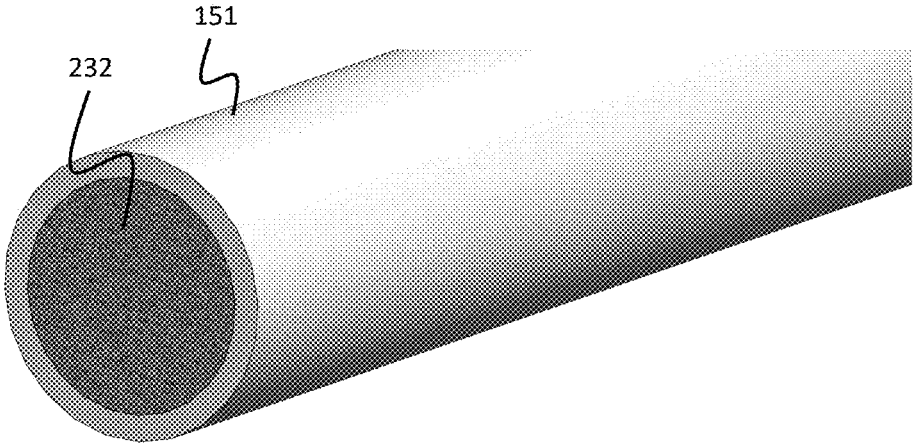
FIG. 5A illustrates a perspective view of a microtube with an internally integrated porous core, according to an embodiment of this disclosure.
Figure 5B:
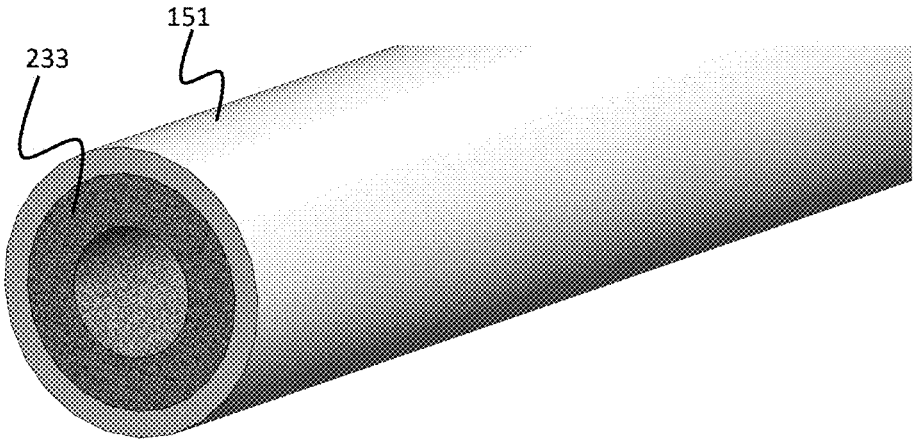
FIG. 5B illustrates a perspective view of a microtube with an internally integrated porous sleeve, according to an embodiment of this disclosure.

FIGS. 5A and 5B illustrate representative alternative embodiments, of which preferably integrate porous metal as a core 232, shown in FIG. 5A, and as a sleeve 233, shown in FIG. 5B, within an individual microtube 151. It should be noted that although porous metal has been described, any thermally conductive material may be contained internally as a core 232 or center section, or as a sleeve 233. Using the porous metal inside the microtubes increases the effective tube-side surface area of the heat exchanger. In microtube heat exchangers, the surface area is limited to the interior wall surface, which does not transfer the maximum amount of heat. Outside the scope of the present disclosure, those of skill in the art will appreciate that liquid passing through the center of the microtubes does not come into contact with the metal heat exchanging surface. Because of this, heat exchanger efficiency decreases. With the teachings of the present disclosure, the surface area of the effective heat exchange surface is increased, which results in higher efficiency.

One possible method of manufacturing both embodiments discussed above, incorporating porous metal into the interior of the individual microtubes 151, utilizes induction heating equipment with specified frequency, power, and duration settings. For example, for microtubes having a porous metal core 232, each microtube 151 can be filled with the desired micron-sized powdered metal. Induction heating would then commence via a close proximity induction coil surrounding the microtube 151. Frequency, power, and duration is preferably optimized for metal powder fusion properties, power usage, and material throughput.

For a microtube having a porous metal sleeve 233, a similar manufacturing method is employed, although induction heating parameters would likely be altered with higher frequency and power to decrease heat penetration depth with higher localized heat. This allows the outer portion of the porous metal sleeve 233 to be fused while not affecting the metal powder near the center of the microtube 151. Once this partial fusion is complete, excess non-fused powder can be removed from the microtube 151 leaving a prescribed porous metal sleeve 233 fused to the inner wall of the microtube 151. This process can be repeated with a different micron-sized powder to achieve multi-layers within the microtube 151 with different porous media properties for each layer. For example, it may be advantageous to make the outermost layer, i.e., the layer in direct contact with the inner wall surface of the microtube 151, from coarse or larger micron-sized metal powder, and then fuse fine or smaller micron-sized metal powder closer to the innermost layer of the porous metal sleeve 233 near and at the center of the microtube 151. This would force the working fluid along the inner tube wall surface to be exposed to the greatest temperature differential while eliminating center tube flow where the least temperature differential exists.

Figure 6:
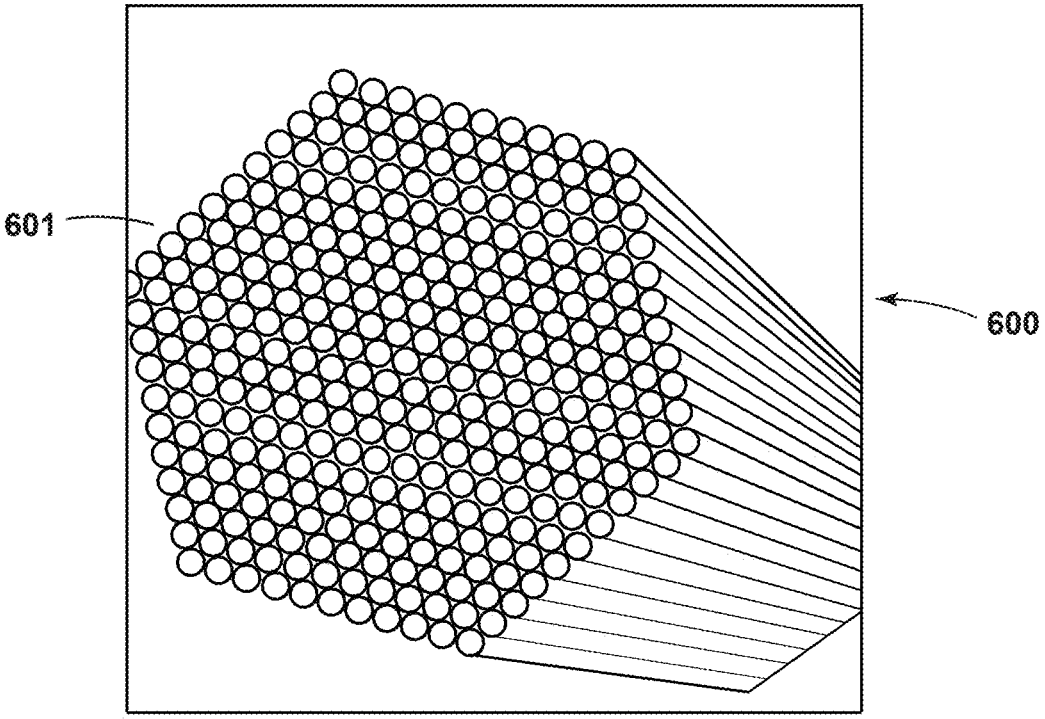
FIG. 6 illustrates a tube stack or capillary bundle, according to an embodiment of this disclosure.

FIG. 6 illustrates a tube stack 600 also called a capillary bundle, with a plurality of microtubes 601, according to an embodiment of this disclosure. Tube stack 600 is substantially the same as tube stack 150, and microtubes 601 are substantially the same as tubes 151, previously described. However, microtubes 601 are formed together as a bundle as opposed to microtubes being formed individually and later combined into a tube stack. This bundle generally forms a hexagonal cross-sectional shape to form tube stack 600, where microtubes 151 are formed in a generally circular cross-section shape to form tube stack 150. Those with skill in the art understand that tube stacks of the disclosure can be formed from individual microtubes or capillary bundles and have general cross-sections of any of a number of shapes, including, for example, square, triangular or rectangular cross-sections.

Figure 7:
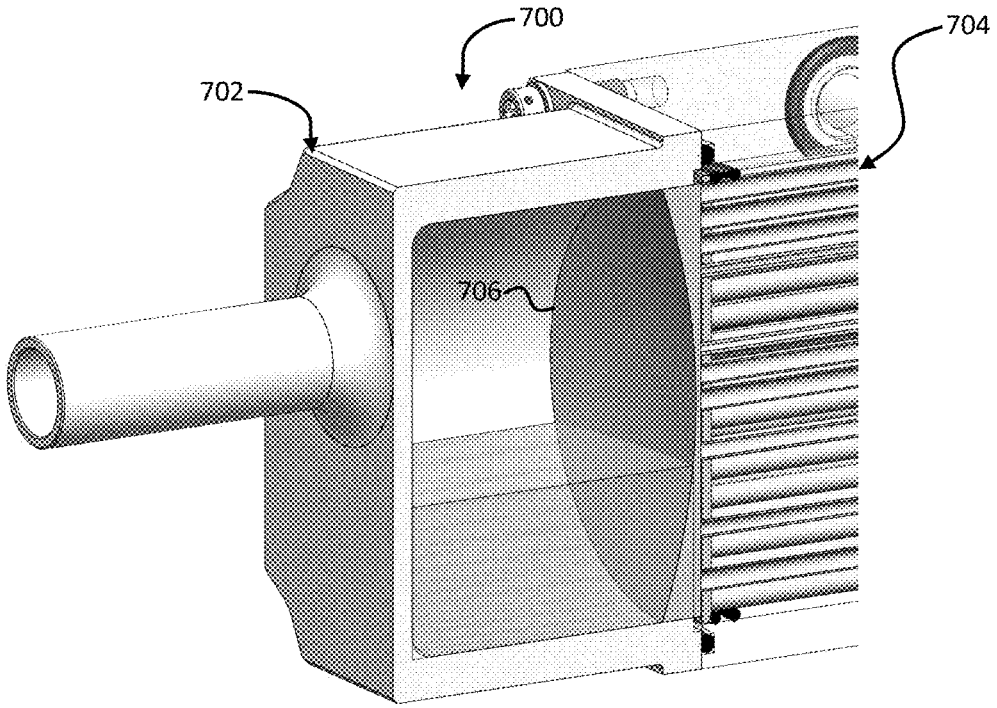
FIG. 7 illustrates a cutaway perspective view of a heat exchanger with a parabolic concave wicking insert, according to an embodiment of this disclosure.

FIG. 7 illustrates a heat exchanger 700 according to another embodiment of this disclosure. Heat exchanger 700 is substantially the same as heat exchanger 100 previously described. Heat exchanger 700 includes an inlet assembly 702 substantially the same as inlet assembly 200, and a tube stack 704 substantially the same as tube stack 150. Heat exchanger 700 further includes a porous insert 706, substantially the same as insert 230 previously described. However, unlike insert 230, which has a uniform thickness, insert 706 has a variable thickness. As shown in FIG. 7, insert 706 has a thickness that conforms with a parabolic concave shape. That is to say, the thickness of insert 706 is at its smallest at a center of insert 706 and increases along a parabolic curve as the radius increases from the center of the insert 706. Those with skill in the art will recognize that insert 706 is preferred for any of a number of different applications. For example, due to the capillary adhesion previously described, insert 706 provides increased refrigerant availability to tubes of tube stack 704 aligned with the thicker areas of insert 706, and thus insert 706 may be preferable in scenarios in which increased fluid flow is desired in outer tubes of tube stack 704. Specifically, insert 706 is configured to distribute increased refrigerant to outer tubes of tube stack 704 and parabolically decrease refrigerant distribution as the tube location gets closer to the center of insert 706. Similarly, due to its thickness profile, insert 706 is configured to provide a largest amount of pressure drop across tube stack 704 at its thickest areas along the outer edge and parabolically decrease in provided pressure drop moving toward the center of insert 706.

Figure 8:
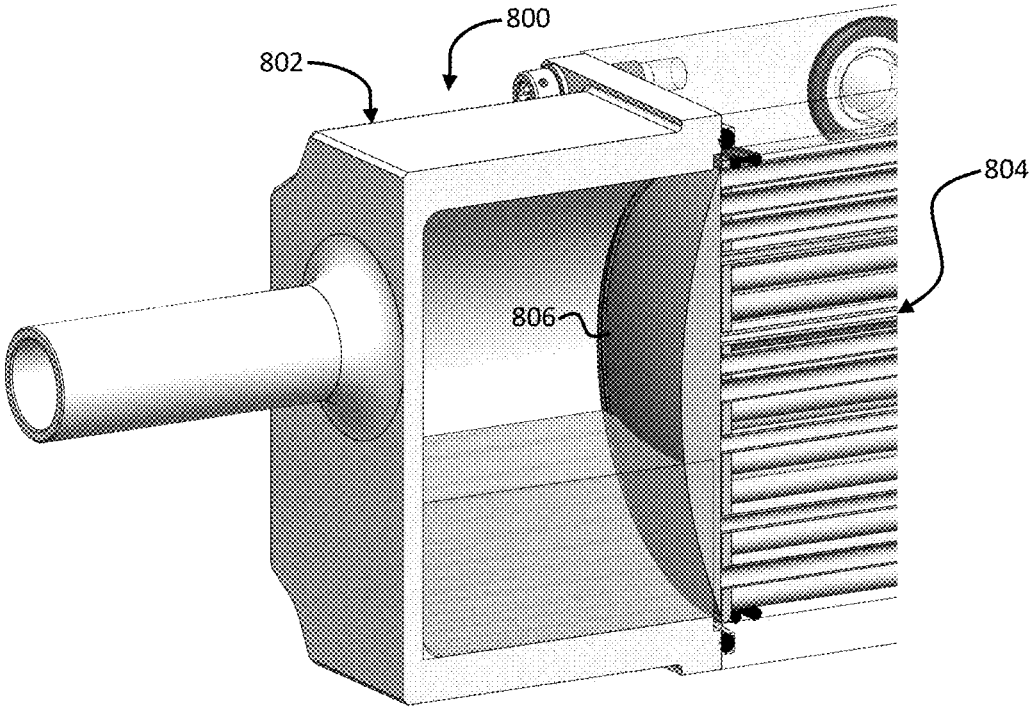
FIG. 8 illustrates a cutaway perspective view of a heat exchanger with a parabolic convex wicking insert, according to an embodiment of this disclosure.

FIG. 8 illustrates a heat exchanger 800 according to another embodiment of this disclosure. Heat exchanger 800 is substantially the same as heat exchanger 100 previously described. Heat exchanger 800 includes an inlet assembly 802 substantially the same as inlet assembly 200, and a tube stack 804 substantially the same as tube stack 150. Heat exchanger 800 further includes a porous insert 806, substantially the same as insert 230 previously described. However, unlike insert 230, which has a uniform thickness, insert 806 has a variable thickness. As shown in FIG. 8, insert 806 has a thickness that conforms with a parabolic convex shape. That is to say, the thickness of insert 806 is at its greatest at a center of insert 806 and decreases along a parabolic curve as the radius increases from the center of the insert 806. Those with skill in the art will recognize that insert 806 is preferred for any of a number of different applications. For example, due to the capillary adhesion previously described, insert 806 provides increased refrigerant availability to tubes of tube stack 804 aligned with the thicker areas of insert 806, and thus insert 806 may be preferable in scenarios in which increased fluid flow is desired in inner tubes of tube stack 804. Specifically, insert 806 is configured to distribute increased refrigerant to inner tubes of tube stack 804 and parabolically decrease refrigerant distribution as the tube location gets further from the center of insert 806. Similarly, due to its thickness profile, insert 806 is configured to provide a largest amount of pressure drop across tube stack 804 at its thickest area at the center and parabolically decrease in provided pressure drop moving outward away from the center of insert 806.

Figure 9:
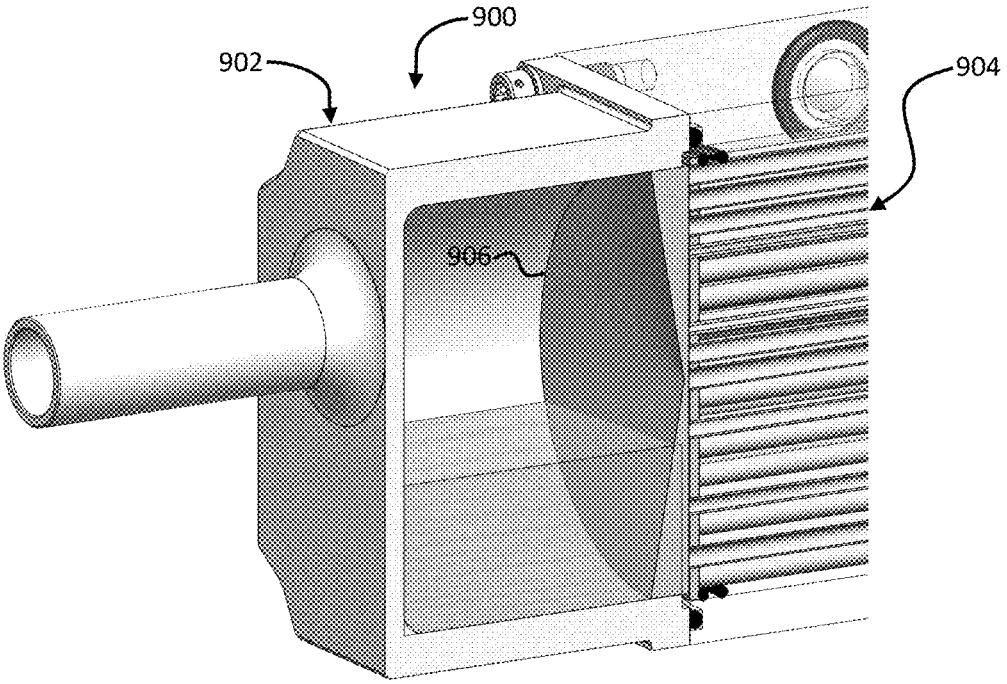
FIG. 9 illustrates a cutaway perspective view of a heat exchanger with a coned concave wicking insert, according to an embodiment of this disclosure.

FIG. 9 illustrates a heat exchanger 900 according to another embodiment of this disclosure. Heat exchanger 900 is substantially the same as heat exchanger 100 previously described. Heat exchanger 900 includes an inlet assembly 902 substantially the same as inlet assembly 200, and a tube stack 904 substantially the same as tube stack 150. Heat exchanger 900 further includes a porous insert 906, substantially the same as insert 230 previously described. However, unlike insert 230, which has a uniform thickness, insert 906 has a variable thickness. As shown in FIG. 9, insert 906 has a thickness that conforms with a concave cone shape. That is to say, the thickness of insert 906 is at its smallest at a center of insert 906 and increases linearly as the radius increases from the center of the insert 906. Those with skill in the art will recognize that insert 906 is preferred for any of a number of different applications. For example, due to the capillary adhesion previously described, insert 906 provides increased refrigerant availability to tubes of tube stack 904 aligned with the thicker areas of insert 906, and thus insert 906 may be preferable in scenarios in which increased fluid flow is desired in outer tubes of tube stack 904. Specifically, insert 906 is configured to distribute increased refrigerant to outer tubes of tube stack 904 and linearly decrease refrigerant distribution as the tube location gets closer to the center of insert 906. Similarly, due to its thickness profile, insert 906 is configured to provide a largest amount of pressure drop across tube stack 904 at its thickest areas along the outer edge and linearly decrease in provided pressure drop moving toward the center of insert 906.

Figure 10:
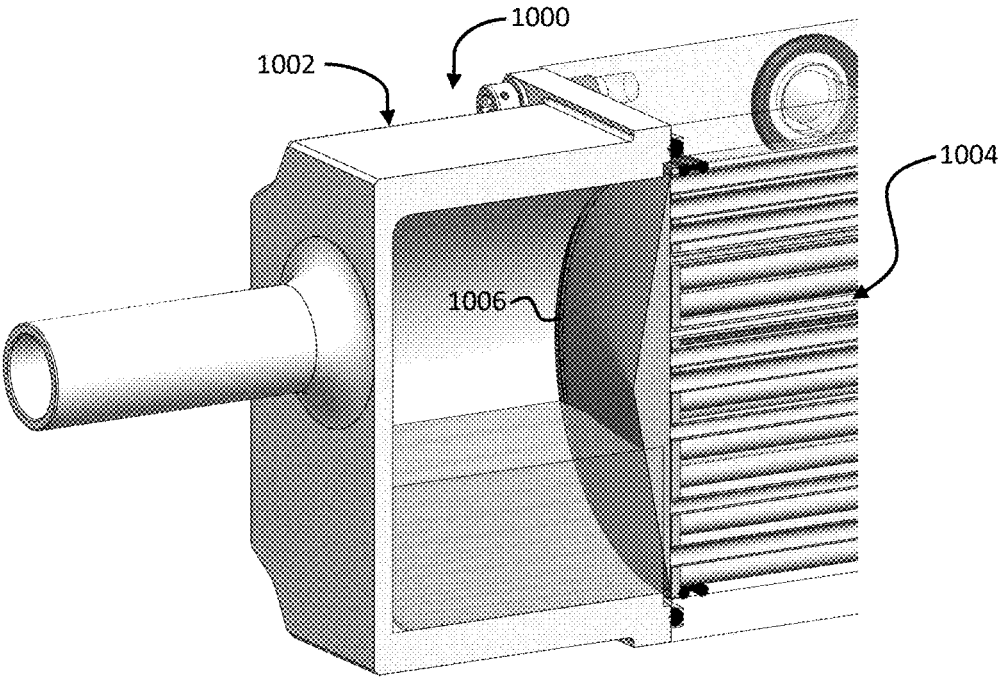
FIG. 10 illustrates a cutaway perspective view of a heat exchanger with a coned convex wicking insert, according to an embodiment of this disclosure.

FIG. 10 illustrates a heat exchanger 1000 according to another embodiment of this disclosure. Heat exchanger 1000 is substantially the same as heat exchanger 100 previously described. Heat exchanger 1000 includes an inlet assembly 1002 substantially the same as inlet assembly 200, and a tube stack 1004 substantially the same as tube stack 150. Heat exchanger 1000 further includes a porous insert 1006, substantially the same as insert 230 previously described. However, unlike insert 230, which has a uniform thickness, insert 1006 has a variable thickness. As shown in FIG. 10, insert 1006 has a thickness that conforms with a convex cone shape. That is to say, the thickness of insert 1006 is at its greatest at a center of insert 1006 and decreases linearly as the radius increases from the center of the insert 1006. Those with skill in the art will recognize that insert 1006 is preferred for any of a number of different applications. For example, due to the capillary adhesion previously described, insert 1006 provides increased refrigerant availability to tubes of tube stack 1004 aligned with the thicker areas of insert 1006, and thus insert 1006 may be preferable in scenarios in which increased fluid flow is desired in inner tubes of tube stack 1004. Specifically, insert 1006 is configured to distribute increased refrigerant to inner tubes of tube stack 1004 and linearly decrease refrigerant distribution as the tube location gets further from the center of insert 1006. Similarly, due to its thickness profile, insert 1006 is configured to provide a largest amount of pressure drop across tube stack 1004 at its thickest area at the center and linearly decrease in provided pressure drop moving outward away from the center of insert 1006.

Figure 11A:
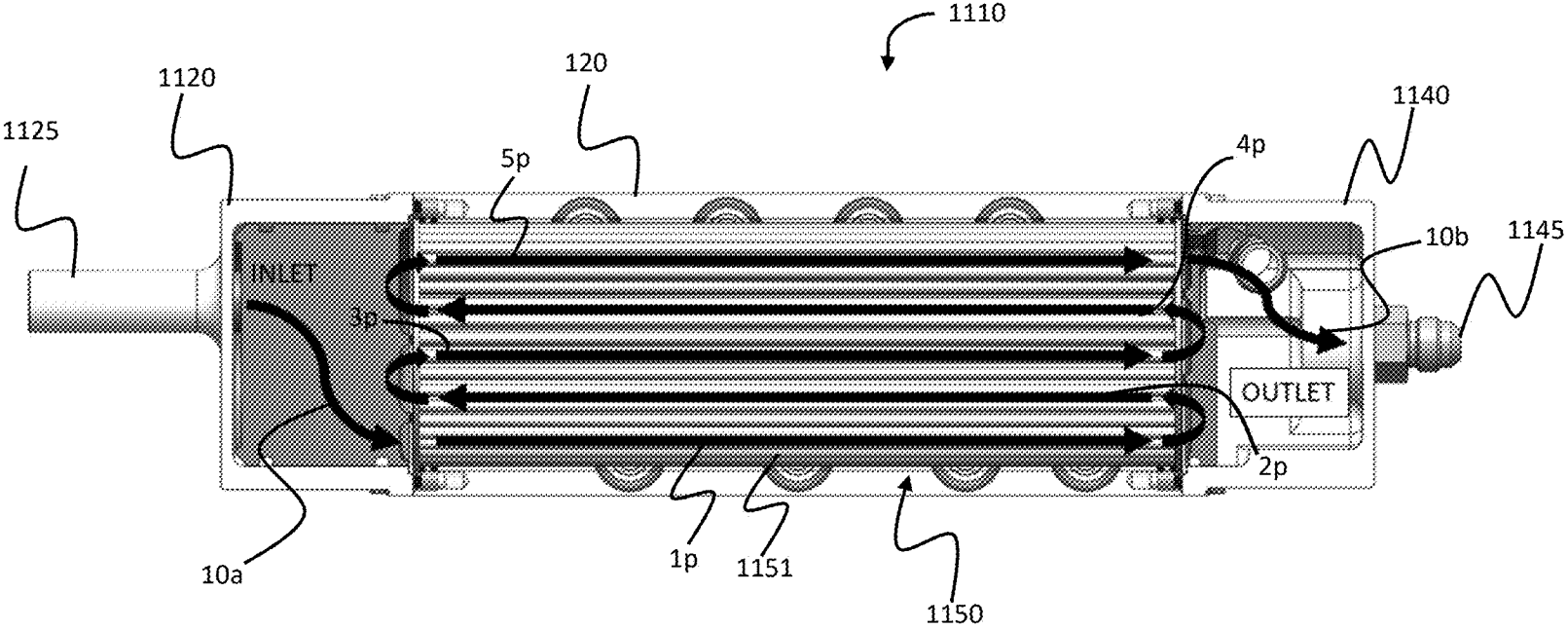
FIG. 11A illustrates a multi-pass microtube heat exchanger, according to an embodiment of this disclosure.

FIG. 11A illustrates a cutaway side view of a heat exchanger 1100, according to another embodiment of this disclosure. Heat exchanger 1100 is substantially similar to heat exchangers disclosed in International Application PCT/US22/29990, the entire disclosure of which is hereby incorporated in the current application by reference. Those with skill in the art will recognize that heat exchanger incorporates many features substantially similar to heat exchanger 100 previously described. For example, heat exchanger 1100 includes a tube stack 1150 with a plurality of microtubes 1151 (substantially the same as tube stack 150 and microtubes 151), an inlet header assembly 1120 with a refrigerant inlet 1125 (substantially similar to header assembly 200 and inlet 205), and outlet header assembly 1140 with a refrigerant outlet 1145 (substantially similar to header assembly 240 and outlet 245).

However, different from heat exchanger 100 which is a single-pass heat exchanger, heat exchanger 1100 is a multi-pass heat exchanger. Specifically, heat exchanger 1100 has five passes 1p, 2p, 3p, 4p, 5p. The multi-pass functionality of heat exchanger 1100 is enabled by header inserts 1160, illustrated in detail in FIGS. 11B-11C.

Figure 11B:
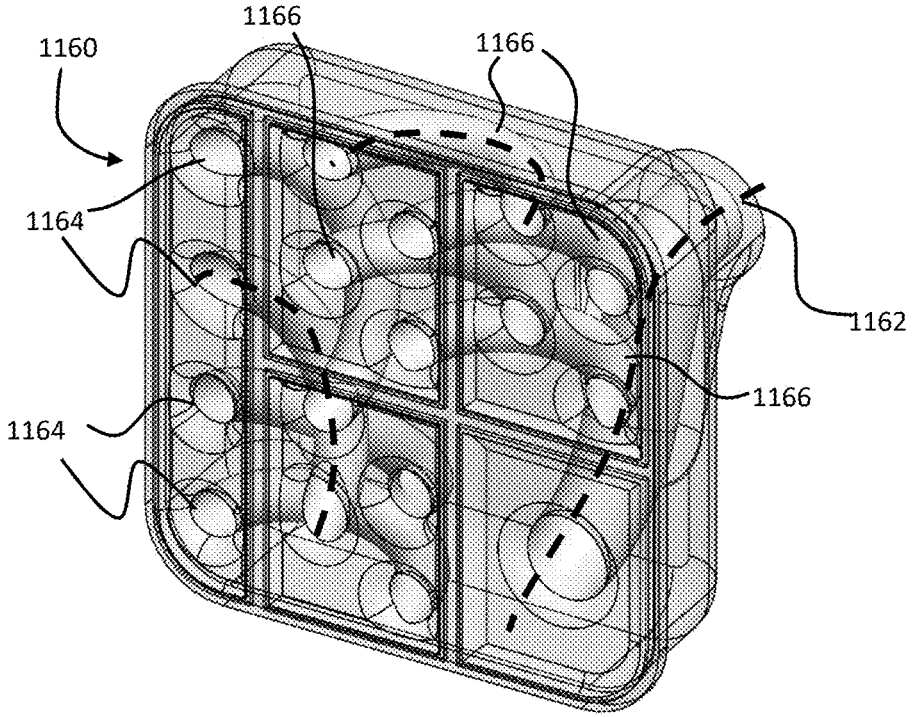
FIG. 11B illustrates a semitransparent perspective view of a header insert of the multi-pass heat exchanger of FIG. 11A.
Figure 11C:
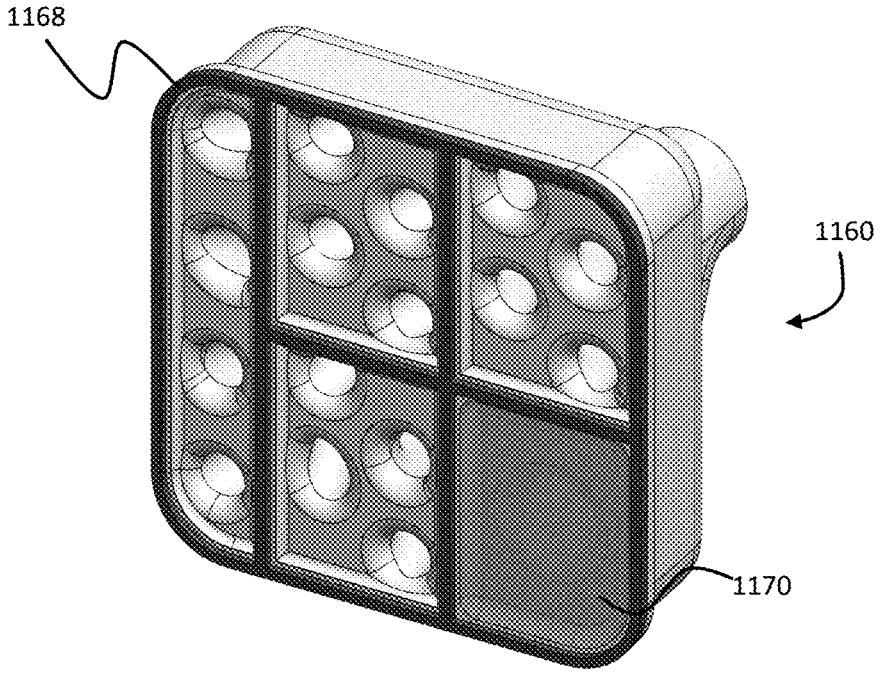
FIG. 11C illustrates a perspective view of the header insert of FIG. 11B further including a wicking insert, according to an embodiment of this disclosure.

FIGS. 11B-11C illustrate perspective views of header insert 1160, which is disposed in each header assembly 1120, 1140. Those with skill in the art will understand that in FIGS. 11B-11C, header insert 1160 is shown in the orientation in which it is disposed in header 1120, and that header insert 1160 is rotated 180 degrees from what is depicted when inserted into header assembly 1140. Together, the inserts 1160 enable the five passes 1p-5p of refrigerant through tube stack 1150.

FIG. 11B is a semitransparent perspective view of header insert 1160 to depict various channels 1162-1166 of insert 1160 which enable the multi-pass functionality of the heat exchanger 1160. Specifically, referencing inlet header assembly 1120, refrigerant enters tube stack 1150 though channel 1162. Refrigerant is received from tube stack 1150 by channels 1164, which then discharge the received fluid back to tube stack 1150. Finally, channels 1166 receive refrigerant from tube stack 1150 and discharge the received fluid back to the tube stack 1150. Those with skill in the art will understand the insert of outlet header assembly 1140 operates in generally an inverse way to the header insert 1160 of inlet header assembly 1120 and results in refrigerant being expelled from tube stack 1150.

FIG. 11C illustrates a perspective view of header insert 1160 and further illustrates gasket 1168 and porous insert 1170. Gasket 1168 seals against an end plate of tube stack 1150 and segregates the plurality of microtubes 1151 into the various passes 1p-5p according to which of the channel 1162-1166 the microtube 1151 is aligned with. Semitransparent porous insert 1170 is substantially the same as insert 230 previously described. Accordingly, refrigerant entering tube stack 1150 through channel 1162 is distributed among the various microtubes 1151 aligned with channel 1162 according to the inherent capillary adhesion and distribution properties of insert 1170 that been previously described. Thus, insert 1170 allows for uniform distribution of refrigerant liquid entering tube stack 1150. Those with skill in the art will understand that other inserts substantially the same as insert 1170 can be incorporated and aligned with other channels 1164, 1166 of header insert 1160, according to various embodiments of this disclosure.

In some embodiments, in addition to or instead of the channels 1162-1166, capillary bundles of tubes FIG. 6 can be used. Capillary bundles are constructed out of materials that are compatible with the working fluid and may allow for flexible geometry. Although the geometry and material of the capillary bundles may differ from the other embodiments described herein, they provide similar functionality in that they induce a low pressure drop while gently redirecting flow, provide even distribution of the working fluid across the microtubes, and homogeneity. In some embodiments, the capillary bundles are similar to capillary arrays developed by INCOM.

Figure 12:
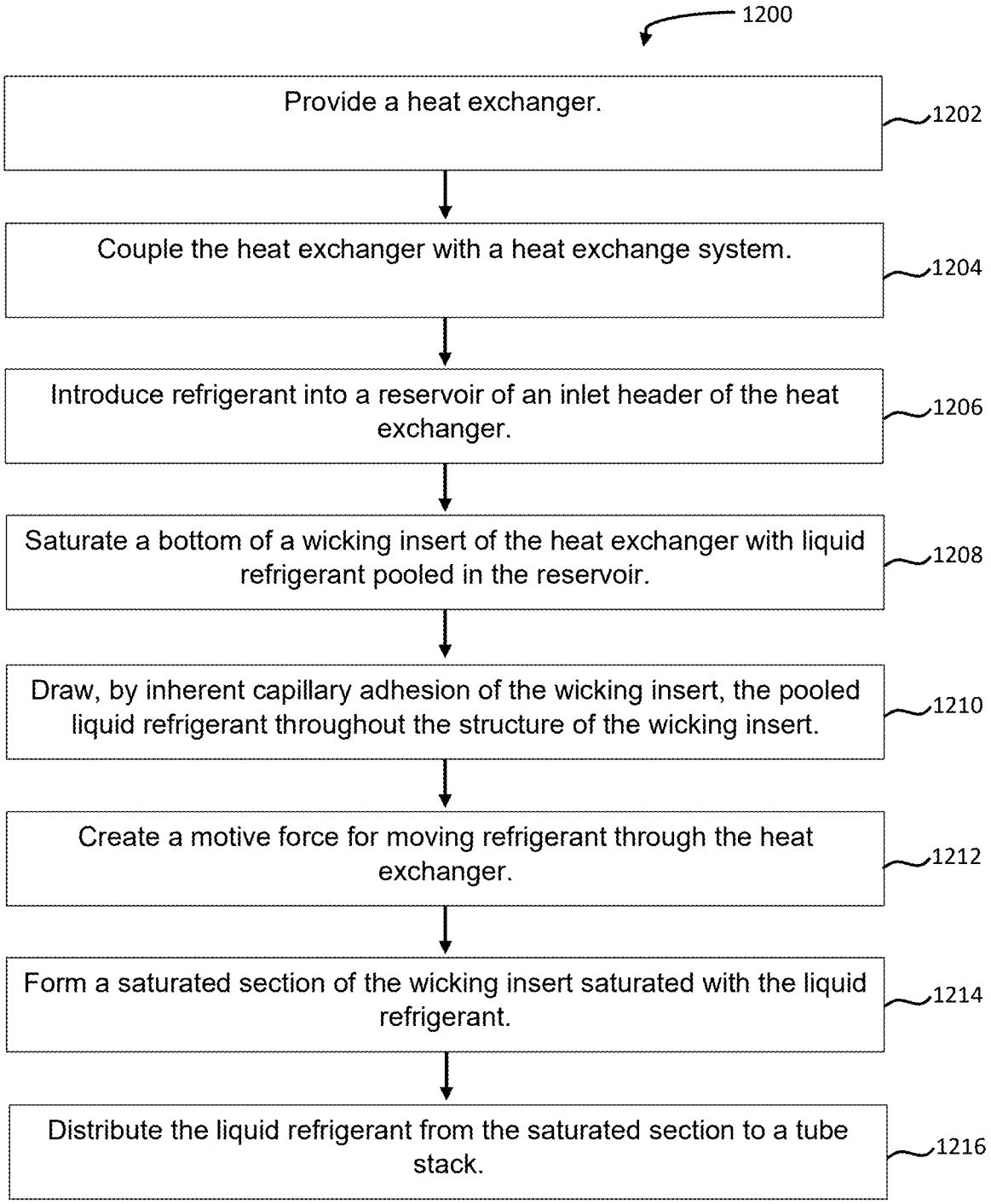
FIG. 12 is a flowchart illustrating a method of distributing a working fluid to an inlet-side of a tube stack of a heat exchanger, according to an embodiment of this disclosure.

FIG. 12 is a flowchart illustrating a method 1200 of distributing refrigerant within heat exchanger 100. Method 1200 can begin at block 1202 with providing heat exchanger 100. Method 1200 can continue to block 1204 by coupling heat exchanger 100 with a heat exchange system, such as heat exchange system 50. Method 1200 can continue at block 1206 by introducing refrigerant of system 50 into reservoir 214 of inlet header assembly 200. Method 1200 can continue at block 1208 saturating a bottom of wicking insert 230 with liquid of the refrigerant pooled at the bottom of reservoir 214 due to gravity. Method 1200 can continue at block 1210 by insert 230 drawing the pooled liquid, by the inherent capillary adhesion/forces of insert 230, throughout the porous structure of wicking insert 230. Method 1200 can continue at block 1212 by creating a motive force within system 50 using compressor 52 for moving refrigerant through heat exchanger 100. Method 1200 can continue at block 1214 by, as a result of the motive force, forming saturated section 231 of insert 230 saturated with liquid of the refrigerant that was drawn by wicking insert in block 1210. Method 1200 can continue at block 1216 by distributing refrigerant liquid from saturated area 231 to an inlet end of each of the plurality of microtubes 151 of tube stack 150.

Those with skill in the art will understand that method 1200 can be performed with more or less than all of the blocks 1202-1216 described without departing from the scope of this disclosure. Additionally, although blocks 1202-1216 are described with an order of operations, those with skill in the art will understand that blocks 1202-1216 can be performed according to any of a number of different orders without departing from the scope of this disclosure.

Although the present invention has been described in terms of the foregoing disclosed embodiments, this description has been provided by way of explanation only and is not intended to be construed as a limitation of the invention. Indeed, even though the foregoing descriptions refer to numerous components and other embodiments that are presently contemplated, those of ordinary skill in the art will recognize many possible alternatives that have not been expressly referenced or even suggested here. While the foregoing written descriptions should enable one of ordinary skill in the pertinent arts to make and use what are presently considered the best modes of the invention, those of ordinary skill will also understand and appreciate the existence of numerous variations, combinations, and equivalents of the various aspects of the specific embodiments, methods, and examples referenced herein.

Hence the drawings and detailed descriptions herein should be considered illustrative, not exhaustive. They do not limit the invention to the particular forms and examples disclosed. To the contrary, the invention includes many further modifications, changes, rearrangements, substitutions, alternatives, design choices, and embodiments apparent to those of ordinary skill in the art, without departing from the spirit and scope of this invention.

Accordingly, in all respects, it should be understood that the drawings and detailed descriptions herein are to be regarded in an illustrative rather than a restrictive manner and are not intended to limit the invention to the particular forms and examples disclosed. In any case, all substantially equivalent systems, articles, and methods should be considered within the scope of the invention and, absent express indication otherwise, all structural or functional equivalents are anticipated to remain within the spirit and scope of the presently disclosed systems and methods.

What is claimed is:

1. A heat exchanger for heating or cooling refrigerant fluid of a heat exchange system, the heat exchanger comprising:

a tube stack assembly including a plurality of microtubes aligned substantially parallel to each other to form a tube stack, wherein refrigerant fluid is configured to pass through an interior of each of the plurality of microtubes so that heat can be transferred between the refrigerant fluid and an external fluid flowing past an exterior of the plurality of microtubes;

an inlet housing disposed adjacent to a refrigerant fluid inlet end of the tube stack assembly, the inlet housing including a reservoir and an inlet configured to be coupled with a refrigerant fluid return line of a heat exchange system, wherein refrigerant fluid is configured to enter the inlet housing via the inlet and be stored in the reservoir, wherein, due to gravity, liquid of the refrigerant fluid is configured to pool in a bottom of the reservoir; and a wicking insert disposed at a tube stack opening of the inlet housing adjacent to and covering the refrigerant fluid inlet end of the tube stack assembly, wherein the wicking insert has a porous structure configured to provide a capillary force within the porous structure and a pore density of the wicking insert is non-uniform, wherein:

a bottom of the wicking insert is disposed within a pooled liquid of the refrigerant fluid and the wicking insert is configured to draw the liquid of the refrigerant fluid from the bottom of the reservoir through the porous structure of the wicking insert due to the capillary force;

a thickness of the wicking insert is defined as spanning from an inner surface of the wicking insert, disposed adjacent to the refrigerant fluid inlet end of the tube stack assembly, to an outer surface opposite the inner surface;

the wicking insert employs a gradient pore density across the thickness of the wicking insert; and the pore density of the wicking insert is largest adjacent to the inner surface and smallest adjacent to the outer surface.

2. The heat exchanger of claim 1, wherein:

a thickness of the wicking insert is defined as spanning from an inner surface of the wicking insert, disposed adjacent to the refrigerant fluid inlet end of the tube stack assembly, to an outer surface opposite the inner surface;

a compressor or pump of the heat exchange system is configured to create a motive force for moving refrigerant fluid from the inlet housing to an outlet housing of the heat exchanger through the plurality of microtubes;

the motive force and the capillary force are configured to create a saturated section of the wicking insert that is saturated with liquid of the refrigerant fluid;

the saturated section spans from the inner surface of the wicking insert across at least part of the thickness of the wicking insert toward the outer surface of the wicking insert; and the saturated section substantially evenly distributes liquid of the refrigerant fluid to the refrigerant fluid inlet end of each of the plurality of microtubes.

3. The heat exchanger of claim 1, wherein the wicking insert is sized to create a desired pressure drop across the tube stack.

4. The heat exchanger of claim 1, wherein one or more microtubes of the plurality of microtubes comprises a porous wicking insert disposed within an interior of the one or more microtubes of the plurality of microtubes.

5. The heat exchanger of claim 1, wherein:

a thickness of the wicking insert is defined as spanning from an inner surface of the wicking insert, disposed adjacent to the refrigerant fluid inlet end of the tube stack assembly, to an outer surface opposite the inner surface; and the thickness of the wicking insert is substantially uniform throughout an entirety of the wicking insert.

6. The heat exchanger of claim 1, wherein:

a thickness of the wicking insert is defined as spanning from an inner surface of the wicking insert disposed adjacent to the refrigerant fluid inlet end of the tube stack assembly, to an outer surface opposite the inner surface; and the thickness of the wicking insert is variable at different sections of wicking insert to provide variable pressure drops across the tube stack corresponding to the different sections of the wicking insert.

7. The heat exchanger of claim 6, wherein a shape of the thickness of wicking insert is generally cone-shaped.

8. The heat exchanger of claim 6, wherein a shape of the thickness of the wicking insert is generally parabolic in shape.

9. The heat exchanger of claim 1, wherein the tube stack assembly further comprises an end plate having an inner face coupled to a refrigerant fluid inlet end of each of the plurality of microtubes and a plurality of through-holes, each of the plurality of through-holes aligned with one of the plurality of microtubes to allow for refrigerant fluid flow into the one of the plurality of microtubes.

10. A method for supplying refrigerant fluid to a refrigerant fluid inlet side of a microtube heat exchanger tube stack, the method comprising:

providing a microtube heat exchanger, the microtube heat exchanger including:

a tube stack assembly including a plurality of microtubes aligned substantially parallel to each other to form the tube stack, wherein refrigerant fluid is configured to pass through an interior of each of the plurality of microtubes so that heat can be transferred between the refrigerant fluid and an external fluid flowing past an exterior of the plurality of microtubes, an inlet housing disposed adjacent to a refrigerant fluid inlet end of the tube stack assembly and including an inlet and a reservoir, and a wicking insert disposed at a tube stack opening of the inlet housing adjacent to and covering the refrigerant fluid inlet end of the tube stack assembly, wherein the wicking insert comprises a metal material and has a porous structure configured to provide a capillary force within the porous structure and a pore density of the wicking insert is non-uniform;

coupling the inlet with a refrigerant fluid return line of a heat exchange system;

introducing refrigerant fluid into the reservoir by the heat exchange system, wherein, due to gravity, liquid of the refrigerant fluid is configured to pool in a bottom of the reservoir;

saturating a bottom of the wicking insert with the pooled liquid of the refrigerant fluid; and drawing, by the capillary force of the wicking insert, the liquid of the refrigerant fluid from the bottom of the reservoir throughout the porous structure of the wicking insert, wherein:

a thickness of the wicking insert is defined as spanning from an inner surface of the wicking insert, disposed adjacent to the refrigerant fluid inlet end of the tube stack assembly, to an outer surface opposite the inner surface;

the wicking insert employs a gradient pore density across the thickness of the wicking insert; and the pore density of the wicking insert is largest adjacent to the inner surface and smallest adjacent to the outer surface.

11. The method of claim 10, wherein:

a thickness of the wicking insert is defined as spanning from an inner surface of the wicking insert, disposed adjacent to the refrigerant fluid inlet end of the tube stack assembly, to an outer surface opposite the inner surface; and the method further comprises:

creating a motive force for moving refrigerant fluid from the inlet housing to an outlet housing of the heat exchanger through the plurality of microtubes, forming, by the motive force and the capillary force, a saturated section of the wicking insert that is saturated with liquid of the refrigerant fluid, wherein the saturated section spans from the inner surface of the wicking insert across at least part of the thickness of the wicking insert toward the outer surface of the wicking insert, and substantially evenly distributing, by the saturated section, liquid of the refrigerant fluid to a refrigerant fluid inlet end of each of the plurality of microtubes.

12. The method of claim 10, wherein the wicking insert is sized to create a desired pressure drop across the tube stack.

13. The method of claim 10, wherein one or more of the plurality of microtubes comprises a porous wicking insert disposed within an interior of the one or more of the plurality of microtubes.

14. The method of claim 10, wherein:

a thickness of the wicking insert is defined as spanning from an inner surface of the wicking insert, disposed adjacent to the refrigerant fluid inlet end of the tube stack assembly, to an outer surface opposite the inner surface; and the thickness of the wicking insert is substantially uniform throughout an entirety of the wicking insert.

15. The method of claim 10, wherein:

a thickness of the wicking insert is defined as spanning from an inner surface of the wicking insert, disposed adjacent to the refrigerant fluid inlet end of the tube stack assembly, to an outer surface opposite the inner surface; and the thickness of the wicking insert is variable at different sections of wicking insert to provide variable pressure drops across the tube stack corresponding to the different sections of the wicking insert.

16. The method of claim 15, wherein a shape of the thickness of wicking insert is generally cone-shaped.

17. The method of claim 15, wherein a shape of the thickness of the wicking insert is generally parabolic in shape.

18. The method of claim 10, wherein the tube stack assembly further comprises an end plate having an inner face coupled to a refrigerant fluid inlet end of each of the plurality of microtubes and a plurality of through-holes, each of the plurality of through-holes aligned with one of the plurality of microtubes to allow for refrigerant fluid flow into the one of the plurality of microtubes.

* * * * *